US008800642B2

(12) United States Patent
Ninagawa et al.

(10) Patent No.: US 8,800,642 B2
(45) Date of Patent: Aug. 12, 2014

(54) HEAT EXCHANGER WITH SIDE PLATE HAVING A THROUGH HOLE

(75) Inventors: Toshihide Ninagawa, Chita (JP); Hidetake Kuwahara, Kariya (JP)

(73) Assignee: Denso Corporation, Kariya (JP)

( * ) Notice: Subject to any disclaimer, the term of this patent is extended or adjusted under 35 U.S.C. 154(b) by 234 days.

(21) Appl. No.: 12/932,813

(22) Filed: Mar. 7, 2011

(65) Prior Publication Data

US 2011/0214848 A1 Sep. 8, 2011

(30) Foreign Application Priority Data

Mar. 8, 2010 (JP) ..... 2010-51094
Mar. 8, 2010 (JP) ..... 2010-51095

(51) Int. Cl.

| | |
|---|---|
| ***F28D 1/00*** | (2006.01) |
| ***F28D 1/02*** | (2006.01) |
| ***F28D 1/04*** | (2006.01) |
| ***F28F 9/00*** | (2006.01) |
| ***F28F 9/02*** | (2006.01) |
| *F28D 1/053* | (2006.01) |
| *F28D 21/00* | (2006.01) |

(52) U.S. Cl.

CPC ..... *F28F 9/001* (2013.01); *F28D 1/05366* (2013.01); *F28D 2021/0094* (2013.01); *F28F 9/0226* (2013.01)

USPC ..... 165/149; 165/148; 165/151; 165/152; 165/153; 165/43; 165/42; 165/81; 165/175; 165/173

(58) Field of Classification Search

USPC ..... 165/148, 149, 151, 152, 153, 43, 42, 165/81, 916, 175, 173

See application file for complete search history.

(56) References Cited

U.S. PATENT DOCUMENTS

| | | | | | |
|---|---|---|---|---|---|
| 4,649,628 | A | * | 3/1987 | Allemandou | 165/148 |
| 4,738,308 | A | * | 4/1988 | Moranne | 165/149 |
| 5,186,239 | A | * | 2/1993 | Young et al. | 165/81 |
| 5,678,628 | A | * | 10/1997 | Aki et al. | 165/149 |
| 6,006,430 | A | * | 12/1999 | Fukuoka et al. | 29/890.03 |

(Continued)

FOREIGN PATENT DOCUMENTS

| | | |
|---|---|---|
| JP | 5-79789 | 3/1993 |
| JP | 9-79788 | 3/1997 |
| JP | 2002-188437 | 7/2002 |
| JP | 2003-097895 | 4/2003 |
| JP | 2005-037037 | 2/2005 |
| JP | 2005-69567 | 3/2005 |
| JP | 2006-027319 | 2/2006 |
| JP | 2007-04334 | 2/2007 |
| JP | 2007-024334 | 2/2007 |
| JP | 2007-120827 | 5/2007 |

OTHER PUBLICATIONS

Office Action mailed Jul. 2, 2013 in the corresponding JP Application No. 2010-051094 with English translation thereof.
Office Action mailed Jul. 2, 2013 in the corresponding JP Application No. 2010-051095 with English translation thereof.

*Primary Examiner* — Brandon M Rosati
*Assistant Examiner* — Claire Rojohn, III
(74) *Attorney, Agent, or Firm* — Harness, Dickey & Pierce, P.L.C.

(57) ABSTRACT

A heat exchanger includes tubes layered in a layering direction, a side plate arranged most outside of the tubes in the layering direction, and a core plate extending in the layering direction. The side plate has an end portion in a longitudinal direction, and the core plate has a wall portion extending in the longitudinal direction. The end portion of the side plate has a brazing section brazed to an outer face of the wall portion of the core plate, and the end portion of the side plate has a through hole located in the brazing section.

8 Claims, 3 Drawing Sheets

(56) References Cited

U.S. PATENT DOCUMENTS

| | | | | |
|---|---|---|---|---|
| 6,357,520 | B1 * | 3/2002 | Kato et al. | 165/149 |
| 2002/0023744 | A1 * | 2/2002 | Kim et al. | 165/177 |
| 2004/0069446 | A1 * | 4/2004 | Horiuchi | 165/43 |
| 2004/0244954 | A1 * | 12/2004 | Goto et al. | 165/153 |
| 2005/0016717 | A1 * | 1/2005 | Lamich et al. | 165/149 |
| 2007/0012424 | A1 * | 1/2007 | Kamiya et al. | 165/81 |
| 2008/0078540 | A1 * | 4/2008 | Loewe et al. | 165/173 |
| 2008/0202737 | A1 * | 8/2008 | Bergschneider et al. | 165/173 |
| 2009/0255657 | A1 * | 10/2009 | Hakamata et al. | 165/178 |
| 2010/0252244 | A1 * | 10/2010 | Ninagawa et al. | 165/177 |
| 2012/0118543 | A1 * | 5/2012 | Ninagawa et al. | 165/148 |

* cited by examiner

HEAT EXCHANGER WITH SIDE PLATE HAVING A THROUGH HOLE

CROSS REFERENCE TO RELATED APPLICATION

This application is based on Japanese Patent Application No. 2010-51094 filed on Mar. 8, 2010 and Japanese Patent Application No. 2010-51095 filed on Mar. 8, 2010, the disclosures of which are incorporated herein by reference in their entirety.

BACKGROUND OF THE INVENTION

1. Field of the Invention

The present invention relates to a heat exchanger.

2. Description of Related Art

JP-A-2007-120827 describes a heat exchanger. The heat exchanger has a core part constructed by alternately layering tubes and fins. A core plate is arranged on an end of the core part in a tube longitudinal direction. The core plate has a tube connection face, and an end of the tube is connected to the tube connection face. The core plate further has a groove portion defined around an outer periphery of the core plate. A tank is fitted into the groove portion.

Further, a reinforcing side plate is arranged on each side of the core part in a direction of layering the tubes and the fins. A longitudinal end portion of the side plate is brazed to an outer wall of the groove portion of the core plate.

However, a contact between the outer wall of the core plate and the side plate may not completely tight because faces of the core plate and the side plate to have the contact are not completely flat. In this case, a sealed space may be locally generated between the outer wall of the core plate and the side plate. If brazing is performed in a state that air is contained in the sealed space, a flux of brazing material becomes difficult to be sufficiently supplied between the outer wall of the core plate and the side plate. If removal of an oxide film is insufficient, accuracy of the brazing is lowered, so that joint strength will be lowered between the core plate and the side plate.

Moreover, the core plate has a tube hole, and the end of the tube is inserted into the tube hole.

The outer wall of the core plate has a nail produced by bending a tip end of the outer wall by 180°. The end portion of the side plate is interposed between the outer wall and the nail. The tubes, the fins and the core plate are brazed with each other after the brazing material is applied in advance.

A layered member is produced by arranging the side plate onto the core part. Then, the tube is inserted into the tube hole of the core plate, and the end portion of the side plate is inserted into a clearance between the outer wall and the nail.

However, a dimension of the core part in the tube layering direction may become larger than a predetermined value because the tube or the fin has the brazing material in advance. In this case, a position of the side plate is easily deviated outward in the layering direction, so that it becomes difficult to insert the side plate into the clearance between the outer wall and the nail.

SUMMARY OF THE INVENTION

In view of the foregoing and other problems, it is an object of the present invention to provide a heat exchanger.

According to a first example of the present invention, a heat exchanger includes tubes, a side plate, a core plate and a tank.

The tubes are layered in a layering direction. The side plate is arranged most outside of the tubes in the layering direction, and extends in a longitudinal direction of the tube. The core plate extends in the layering direction, and a longitudinal end of the tube is connected to the core plate. The tank is connected to the core plate. The side plate has an end portion in a longitudinal direction of the side plate, and the core plate has an end portion in a longitudinal direction of the core plate. The end portion of the side plate has a brazing section brazed to an outer wall face of the end portion of the core plate. The end portion of the side plate has a through hole located in the brazing section.

Accordingly, the brazing can be accurately and easily performed.

According to a second example of the present invention, a heat exchanger includes tubes, a side plate, a core plate and a tank. The tubes are layered in a layering direction. The side plate is arranged most outside of the tubes in the layering direction, and extends in a longitudinal direction of the tube. The core plate extends in the layering direction, and a longitudinal end of the tube is connected to the core plate. The tank is connected to the core plate. The side plate has an end portion in a longitudinal direction of the side plate, and the core plate has a wall portion extending in the tube longitudinal direction. The core plate further has a U-shaped nail defined by bending a tip end of the wall portion opposing to the tank toward the tube. The nail is located outside of the wall portion in the layering direction. The end portion of the side plate is interposed between an outer face of the wall portion and the nail, and the nail has a bent part defined by bending a tip end of the nail outward in the layering direction.

Accordingly, the heat exchanger can be accurately and easily produced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

In a first embodiment, a heat exchanger of the present invention is applied to a radiator 100 that cools a vehicle engine (cooling water) using air.

Figure 1:
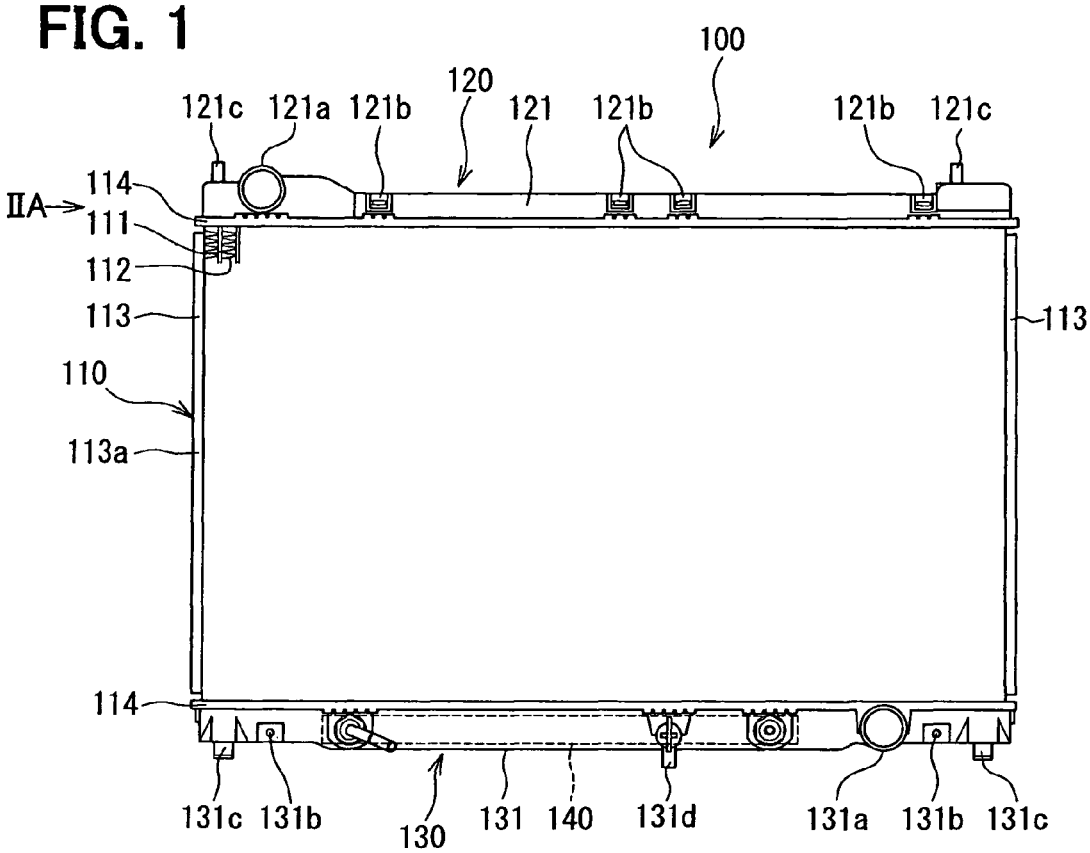
FIG. 1 is a schematic front view illustrating a radiator according to a first embodiment.

As shown in FIG. 1, the radiator 100 has a core part 110, an upper tank 120, and a lower tank 130, for example. The radiator 100 may be a vertical flow type radiator, and cooling water passes through the core part 110 downward in FIG. 1.

The core part 110 has tubes 111, fins 112, a side plate 113, and a core plate 114, which are made of aluminum or aluminum alloy excellent in strength and corrosion resistance.

The tube 111 is a pipe component, and cooling water passes through the tube 111. The tube 111 has a flat cross-section, and is produced by bending a band-shaped member, for example. The fin 112 is a heat emitting component that increases a heat transmission area (heat emitting area). The fin 112 is a corrugated fin having wave shape, and is produced by a roller process using a thin board member, for example.

Figure 2A:
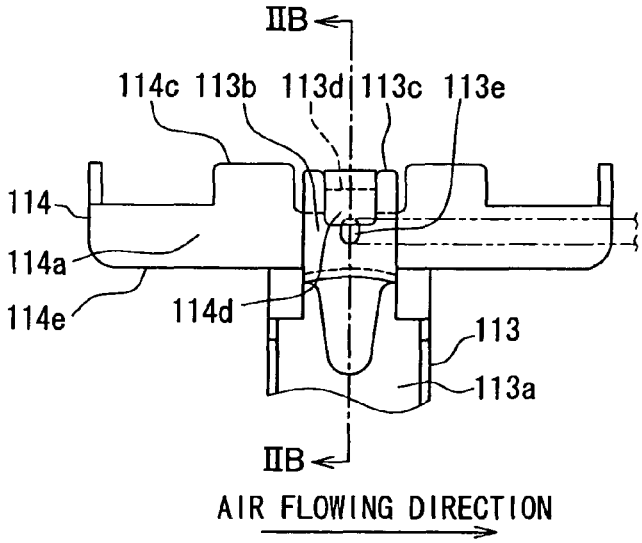
FIG. 2A is a side view illustrating the radiator seen from an arrow direction IIA of FIG. 1.
Figure 2B:
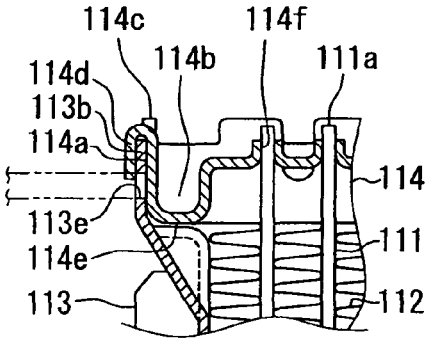
FIG. 2B is a cross-sectional view taken along line IIB-IIB of FIG. 2A.

The side plate 113 is a reinforcement component, and extends along the tube 111 with a relatively small width. A longitudinal dimension of the side plate 113 is set approximately equal to that of the tube 111. As shown in FIG. 2A, the side plate 113 is constructed by a general part 113*a* and a longitudinal end portion 113*b*. The general part 113*a* is located at middle of the side plate 113 in the longitudinal direction, and has a U-shaped cross-section open outward in the tube layering direction. The end portion 113*b* has a flat shape constructed by only a base of the U-shaped general part 113*a*, and is produced by bending the side plate 113 so as to define a step relative to the general part 113*a* outward in the tube layering direction, as shown in FIG. 2B. As shown in FIG. 2A, the end portion 113*b* has a tip end 113*c*, and a rectangular cutout 113*d* is defined at center of the tip end 113*c* in an air flowing direction. The air flowing direction is approximately perpendicular to the tube layering direction and the tube longitudinal direction. A dimension of the end portion 113*b* is smaller than that of the general part 113*a* in the air flowing direction.

The core plate 114 is a narrow board member extending in the tube layering direction. As shown in FIG. 2B, a groove portion 114*b* is formed around all outer periphery of the core plate 114 using a pressing machine. The groove portion 114*b* has a wall extending in the tube longitudinal direction, and plural nails 114*c* are defined on an end of the wall in the tube longitudinal direction. The end portion 113*b* of the side plate 113 is connected to an outer face of the wall of the core plate 114, and the outer face is located in an end portion of the core plate 114 in the tube longitudinal direction. The outer face is hereinafter defined as an outer wall face 114*a*.

As shown in FIG. 2A, the outer wall face 114*a* has plural (two) of the nails 114*c* located at symmetrical positions relative to a center of the core plate 114 in the air flowing direction. An interval between the two nails 114*c* is set larger than the dimension of the end portion 113*b* in the air flowing direction. The core plate 114 further has an insertion nail 114*d* located between the two nails 114*c* in the air flowing direction. The insertion nail 114*d* originally protrudes from a tip end of the outer wall face 114*a* toward the upper tank 120, and is formed by being bent outward by 180° toward the tube 111. That is, the insertion nail 114*d* has a U-shaped bent part and a main part. The bent part is defined by bending the tip end of the outer wall face 114*a* toward the tube 111. The main part further extends from the bent part toward the tube 111. A clearance is defined between the outer wall face 114*a* and the insertion nail 114*d*, and has a dimension corresponding to a thickness of the end portion 113*b* of the side plate 113.

As shown in FIG. 2B, a lower face 114*e* of the core plate 114 opposes to the tube 111. Plural tube holes 114*f* are defined in the core plate 114 in an area inside of the groove portion 114*b*, and positions and shapes of the holes 114*f* correspond to positions and shapes of the layered tubes 111, respectively.

The tubes 111 and the fins 112 are alternately layered with each other in the layering direction corresponding to a left-and-right direction of FIG. 1. A bent part of the wave-shaped fin 112 is contact with an outer wall face of the tube 111. The side plate 113 is located most outside in the tube layering direction, and a position of the chip end 113*c* of the side plate 113 corresponds to a position of an end 111*a* of the tube 111 in the tube longitudinal direction.

The end 111*a* of the tube 111 is inserted into the tube hole 114*f* of the core plate 114. The end portion 113*b* of the side plate 113 contacts the outer wall face 114*a* of the core plate 114. The end portion 113*b* and the cutout 113*d* are located in the clearance between the outer wall face 114*a* and the insertion nail 114*d*.

The tubes 111, the fins 112, the side plate 113, and the core plate 114 are integrally brazed with each other so as to define the core part 110 after a brazing material is applied on each surface of the tube 111, the side plate 113, and the core plate 114.

The tank 120, 130 is a narrow semi-container member extending in the longitudinal direction of the core plate 114. The tank 120, 130 is mechanically connected to the core plate 114 by swaging the nails 114*c* through a sealing gasket (not shown) arranged in the groove portion 114*b* of the core plate 114. Inside of the tube 111 communicates with an inner space of the tank 120, 130.

The upper tank 120 distributes cooling water from the engine to each tube 111, and is made of resin material such as polyamide (PA). The upper tank 120 has an approximately U-shape cross-section when cut in a direction perpendicular to the longitudinal direction. The upper tank 120 has a main part 121 as the semi-container member, and a face of the main part 121 opposing to the core plate 114 is open. The main part 121 integrally has a pipe 121*a*, plural shroud holders 121*b* (4 positions), and plural vehicle mount parts 121*c* (2 positions). Cooling water flows into the tank 120 through the pipe 121*a*. A blower shroud (not shown) is attached to the shroud holders 121*b*. The radiator 100 is attached to a vehicle chassis (not shown) through the vehicle mount parts 121*c*.

The lower tank 130 gathers cooling water from each tube 111, and is made of resin material such as polyamide (PA). The lower, tank 130 has an approximately U-shape cross-section when cut in a direction perpendicular to the longitudinal direction, similar to the upper tank 120. The lower tank 130 has a main part 131 as the semi-container member, and a face of the main part 131 opposing to the tube 111 is open. The main part 131 integrally has a pipe 131*a*, plural shroud holders 131*b* (2 positions), plural vehicle mount parts 131*c* (2 positions), and a drain port 131*d*. Cooling water flows out of the tank 130 through the pipe 131*a*. The blower shroud is attached to the shroud holders 131*b*. The radiator 100 is attached to the vehicle chassis through the vehicle mount parts 131*c*. The drain port 131*d* is used for discharging cooling water at a maintenance time. An oil cooler 140 is disposed in the lower tank 130, and cools automatic transmission fluid (ATF) for an automatic shift of the vehicle.

The end portion 113*b* of the side plate 113 has a through hole 113*e* in a section to be brazed with the outer wall face 114*a*. As shown in FIG. 2A, the through hole 113*e* is located at center of the end portion 113*b* in the air flowing direction. The through hole 113*e* has an oval (ellipse) shape, and the oval shape has a major axis extending in the longitudinal direction of the side plate 113.

The through hole 113*e* is formed by a punching process using a pressing machine, and the punching is performed from left to right in FIG. 2B. That is, a pressing burr is formed on a face of the end portion 113*b* opposing to the outer wall face 114*a* in the punching process.

For example, the radiator 100 is arranged at a front part of an engine compartment of the vehicle, and is located rear of a grill. The vehicle mount part 121*c*, 131*c* is fixed to a frame of the vehicle. An inlet hose extending from the engine is connected to the pipe part 121*a*. An outlet hose extending from the engine is connected to the pipe part 131*a*.

Cooling water flows into the upper tank 120 from the engine through the inlet hose and the pipe part 121*a*, and is distributed into the tubes 111. While cooling water flows through each of the tubes 111, cooling water is cooled by exchanging heat with air. At this time, the heat exchange is accelerated by the fin 112. Cooling water is gathered by the lower tank 130, and flows toward the engine through the pipe part 131*a* and the outlet hose.

In the radiator 100 of the present embodiment, the end portion 113*b* and the cutout 113*d* of the side plate 113 are inserted into the clearance between the outer wall face 114*a* and the insertion nail 114*d*. The side plate 113 is connected to the core plate 114 in the state that the end portion 113*b* contacts the outer wall face 114*a*. In a conventional radiator having such construction, an outer wall of a core plate and an end portion of a side plate may not have a completely tight contact with each other because faces of the core plate and the side plate to be connected with each other are not completely flat. In this case, a sealed space may be locally generated between the core plate and the side plate. If brazing is performed in a state that air is contained in the sealed space, flux of brazing material becomes difficult to be sufficiently supplied for a connection between the core plate and the side plate. If removal of an oxide film is insufficient, accuracy of the brazing will be lowered. That is, a joint strength between the side plate and the core plate may be lowered in the conventional radiator.

In contrast, according to the present embodiment, the through hole 113*e* is defined in the end portion 113*b* of the side plate 113. A clearance generated between the side plate 113 and the core plate 114 can communicate with outside by the through hole 114*e* while the brazing is performed between the end portion 113*b* and the outer wall face 114*a*. That is, even if a sealed space exists between the end portion 113*b* and the outer wall face 114*a*, air purge is possible. The flux of the brazing material can be continuously supplied, and the oxide film can be securely removed by the flux of the brazing material. Thus, the accuracy of the brazing can be improved between the side plate 113 and the core plate 114, according to the present embodiment.

After the brazing, a state of the brazing material around the brazing section between the end portion 113 and the outer wall face 114*a* can be visually confirmed through the through hole 113*e*, so that brazing quality can be easily checked.

The through hole 113*e* is formed by the punching process using the pressing machine. The burr generated in the punching process is formed on the face of the end portion 113*b* opposing to the outer wall face 114*a*. Therefore, a tip end of the burr contacts the outer wall face 114*a* when the brazing is performed. The accuracy of the brazing is further improved because the contact point between the burr and the outer wall face 114*a* can be a start point of the brazing.

The through hole 113*e* has the oval shape, and the major axis of the oval shape extends in the longitudinal direction of the side plate 113. Therefore, the through hole 113*e* passes through the side plate 113 with maintaining a predetermined brazing area between the end portion 113*b* and the outer wall face 114*a*.

The core plate 114 has the insertion nail 114*d*, and the end portion 113*b* of the side plate 113 is inserted between the outer wall face 114*a* and the insertion nail 114*d*. The end portion 113*b* of the side plate 113 can be fixed between the outer wall face 114*a* and the insertion nail 114*d*, while the tubes 111, the fins 112, the side plate 113, and the core plate 114 are assembled so as to form the core part 110. Therefore, the side plate 113 can be held by the core plate 114, and a unit of the core part 110 can be easily handled.

The burr is formed around the through hole 113*e* on the face of the side plate 113 opposing to the outer wall face 114*a* in the punching process. Alternatively, the burr may be eliminated if the brazing material can suitably flow between the end portion 113*b* of the side plate 113 and the outer wall face 114*a*. That is, the burr may be formed around the through hole 113*e* on a side of the side plate 113 opposite from the outer wall face 114*a*. In a case where the burr is unnecessary, the through hole 113*e* may be formed by a cutting and shaving process in place of the punching process.

The shape of the through hole 113*e* is not limited to the oval shape, and may be other shape such as circle or rectangle in accordance with the predetermined brazing area between the end portion 113*b* of the side plate 113 and the outer wall face 114*a*.

The insertion nail 114*d* may be eliminated in a case where an original jig is used for fixing the side plate 113 to the tubes 111, the fins 112 and the core plate 114 while the core part 110 is assembled.

The radiator 100 to cool the engine is an example of the heat exchanger. However, the heat exchanger is not limited to the radiator 100. Alternatively, the heat exchanger may be an inter cooler to cool intake air of the engine or a condenser for a refrigerating cycle.

Second Embodiment

In a second embodiment, a heat exchanger of the present invention is applied to a radiator 200 that cools a vehicle engine (cooling water) using cooled air.

Figure 3:
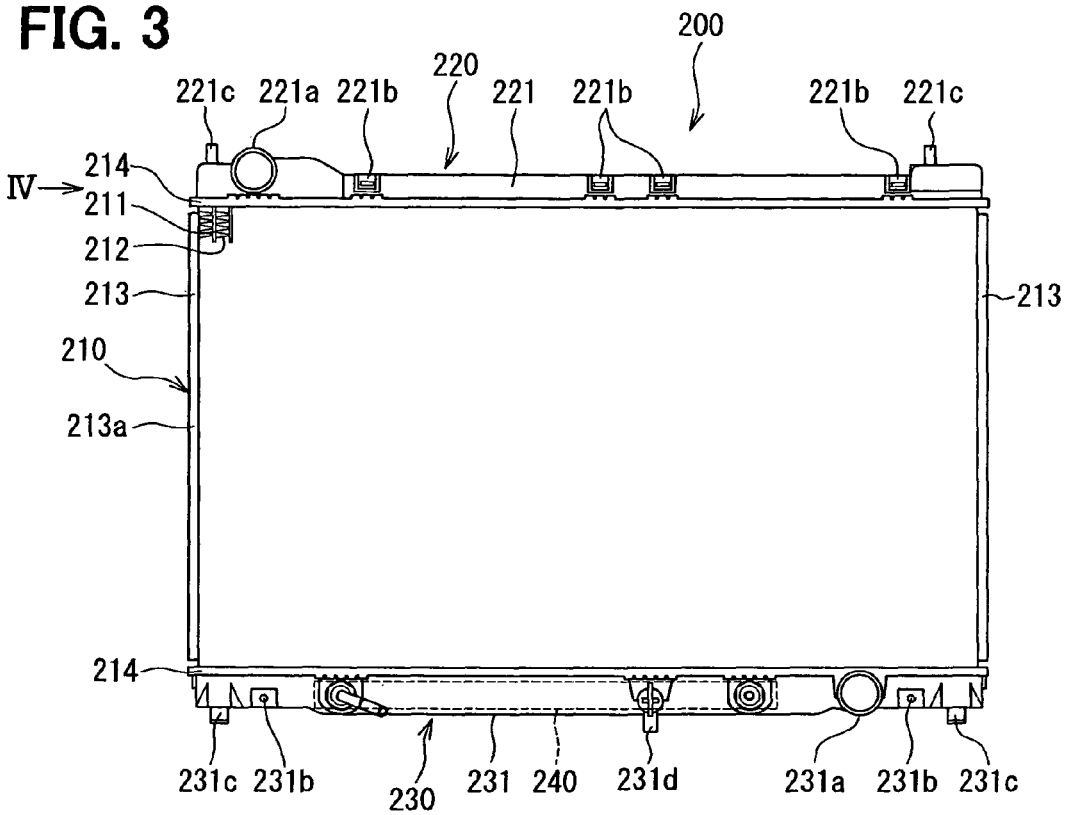
FIG. 3 is a schematic front view illustrating a radiator according to a second embodiment.

As shown in FIG. 3, the radiator 200 has a core part 210, an upper tank 220, and a lower tank 230, for example. The radiator 200 may be a vertical flow type radiator, and cooling water passes through the core part 210 downward in FIG. 3.

The core part 210 has tubes 211, fins 212, a side plate 213, and a core plate 214, which are made of aluminum or aluminum alloy excellent in strength and corrosion resistance.

The tube 211 is a pipe component, and cooling water passes through the tube 211. The tube 211 has a flat cross-section, and is produced by bending a band-shaped member, for example. The fin 212 is a heat emitting component that increases a heat transmission area (heat emitting area). The fin 212 is a corrugated fin having wave shape, and is produced by a roller process using a thin board member, for example.

The side plate 213 is a reinforcement component, and extends along with the tube 211 with a relatively small width. A longitudinal dimension of the side plate 213 is set approximately equal to that of the tube 211. As shown in FIG. 4A, the side plate 213 is constructed by a general part 213*a* and a longitudinal end portion 213*b*. The general part 213*a* is located at middle of the side plate 213 in the longitudinal direction, and has a U-shaped cross-section open outward in the tube layering direction. The end portion 213*b* has a flat shape constructed by only a base of the U-shaped general part 213*a*, and is produced by bending the side plate 213 so as to define a step relative to the general part 213*a* outward in the tube layering direction, as shown in FIG. 5. A dimension of the end portion 213*b* is smaller than that of the general part 213*a* in an air flowing direction that is approximately perpendicular to the tube layering direction and the tube longitudinal direction.

The end portion 213*b* of the side plate 213 has a tip end 213*c*. A face of the tip end 213*c* opposing to a nail 214*d* has a taper part 213*d*. That is, the taper part 213*d* is formed by chamfering the face of the tip end 213*c* opposing to the nail 214*d*. A thickness of the taper part 213*d* becomes smaller as extending toward the tip end 213*c*. The taper part 213*d* is produced by cutting or shaving a part of the tip end 213*c*, or by crushing a part of the tip end 213*c* using a pressing machine. Alternatively, a press shear is formed as the taper part 213*d* while the side plate 213 is produced by a pressing process.

Figure 4:
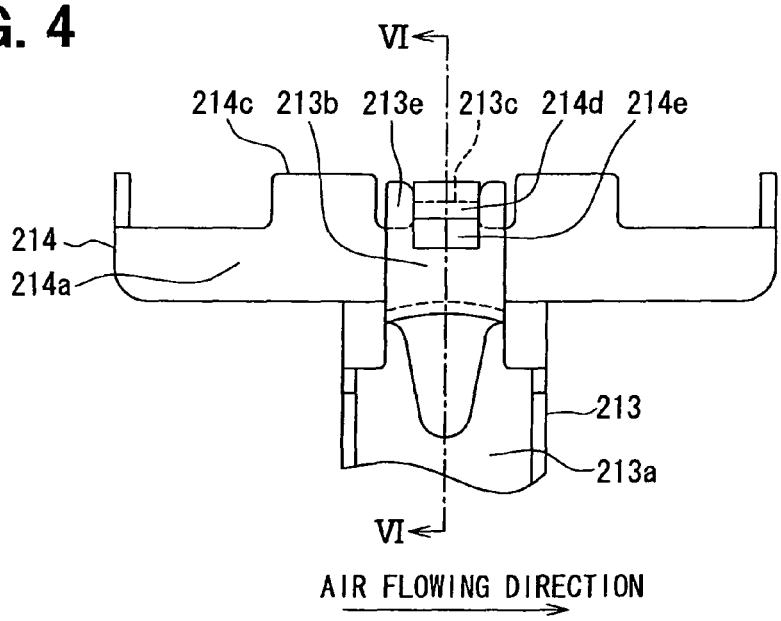
FIG. 4 is a side view illustrating the radiator seen from an arrow direction IV of FIG. 3.
Figure 5:
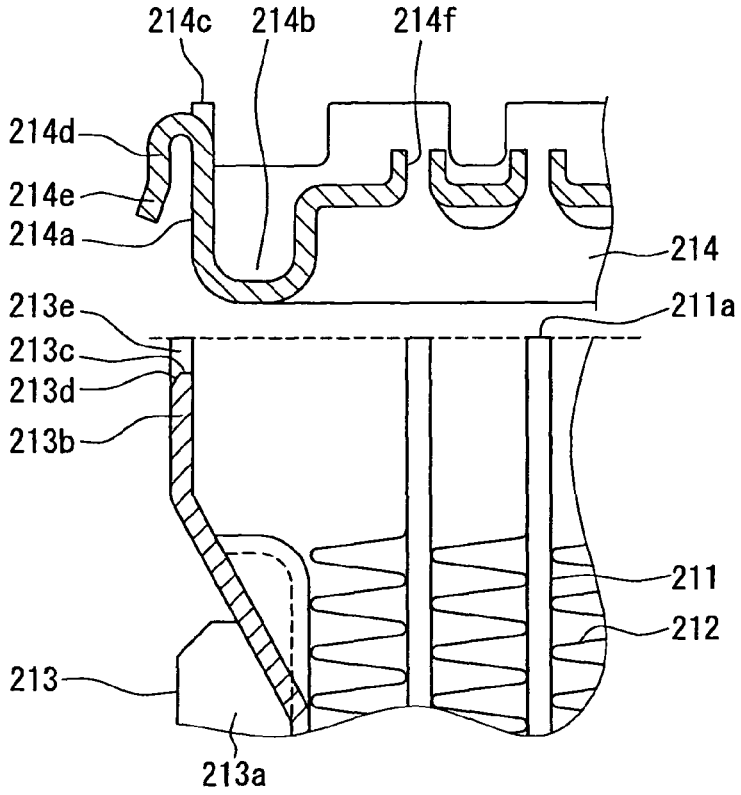
FIG. 5 is an exploded view illustrating tubes, fins, a side plate and a core plate of the radiator of the second embodiment.

As shown in FIG. 4, a dimension of the end portion 213*b* is larger than that of the nail 214*d* in the air flowing direction. Further, the end portion 213*b* has an extension 213*e* extending from a tip end of the side plate 213 toward the upper tank 220. The extension 213*e* is located outside of the nail 214*d* in the air flowing direction. The nail 214*d* is located between two of the extensions 213*e*.

The core plate 214 is a narrow board member extending in the tube layering direction. As shown in FIG. 5, a groove portion 214*b* is formed around all outer periphery of the core plate 214 using a pressing machine. The groove portion 214*b* has a wall extending in the tube longitudinal direction, and plural nails 214*c* are defined on an end of the wall in the tube longitudinal direction. The end portion 213*b* of the side plate 213 is connected to an outer face of the wall of the core plate 214, and the outer face is located in an end portion of the core plate 214 in the tube longitudinal direction. The outer face is hereinafter defined as an outer wall face 214*a*.

As shown in FIG. 4, the outer wall face 214*a* has plural (two) of the nails 214*c* located at symmetrical positions relative to a center of the core plate 214 in the air flowing direction. An interval between the two nails 214*c* is set larger than the dimension of the end portion 213*b* in the air flowing direction. The core plate 214 further has an insertion nail 214*d* located between the two nails 214*c* in the air flowing direction. The insertion nail 214*d* originally protrudes from a tip end of the outer wall face 214*a* toward the upper tank 220, and is formed by being bent by 180° toward the tube 211. That is, the insertion nail 214*d* has a U-shaped bent part and a main part. The bent part is defined by bending the tip end of the outer wall face 214*a* toward the tube 211. The main part further extends from the bent part toward the tube 211.

A dimension of the nail 214*d* is set smaller than that of the end portion 213*b* in the air flowing direction. As shown in FIG. 5, the nail 214*d* has a bent part 214*e* produced by bending a tip end of the nail 214*d* outward in the tube layering direction. The bent part 214*e* is defined by a lower half of the nail 214*d* in the tube longitudinal direction. The bent part 214*e* linearly extends toward its tip end. Therefore, in a section not having the bent part 214*e*, a dimension of a clearance defined between the outer wall face 214*a* and the nail 214*d* corresponds to a thickness of the end portion 213*b*. In a section having the bent part 214*e*, the clearance becomes larger toward the tip end of the bent part 214*e*.

As shown in FIG. 5, plural tube holes 214*f* are defined in the core plate 214 in an area inside of the groove portion 214*b*, and positions and shapes of the holes 214*f* correspond to positions and shapes of the layered tubes 211, respectively.

The tubes 211 and the fins 212 are alternately layered with each other in the layering direction corresponding to a left-and-right direction of FIG. 3. A bent part of the wave-shaped fin 212 is contact with an outer wall face of the tube 211. The side plate 213 is located most outside in the tube layering direction, and a tip end position of the extension 213*e* corresponds to a position of an end 211*a* of the tube 211 in the tube longitudinal direction, as shown in a dashed line of FIG. 5.

Figure 6:
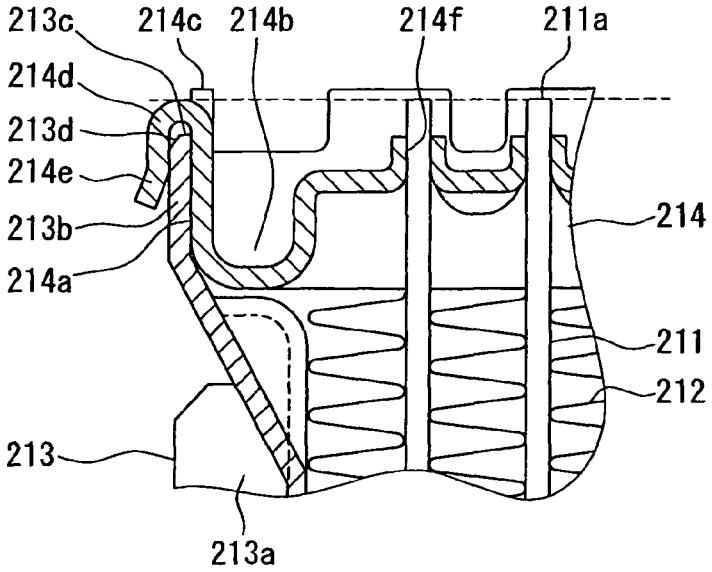
FIG. 6 is a cross-sectional view taken along line VI-VI of FIG. 4.

As shown in FIG. 6, the end 211*a* of the tube 211 is inserted into the tube hole 214*f* of the core plate 214. The end portion 213*b* of the side plate 213 is inserted into the clearance between the outer wall face 214*a* and the nail 214*d*, and contacts the outer wall face 214*a*. As shown in FIG. 4, the extension 213*e* is located each outside of the nail 214*d* in the air flowing direction. As shown in a dashed line of FIG. 6, an end position of the nail 214*d* adjacent to the upper tank 220 is coincident with the position of the end 211*a* of the tube 211 and the end position of the extension 213*e* in the tube longitudinal direction.

The tubes 211, the fins 212, the side plate 213, and the core plate 214 are integrally brazed with each other so as to define the core part 210 after a brazing material is applied on each surface of the tube 211, the side plate 213, and the core plate 214.

The tank 220, 230 is a narrow semi-container member extending in the longitudinal direction of the core plate 214. The tank 220, 230 is mechanically connected to the core plate 214 by swaging the nails 214*c* through a sealing gasket (not shown) arranged in the groove portion 214*b* of the core plate 214. Inside of the tube 211 communicates with an inner space of the tank 220, 230.

The upper tank 220 distributes cooling water from the engine to each tube 211, and is made of resin material such as polyamide (PA). The upper tank 220 has an approximately U-shape cross-section when cut in a direction perpendicular to the longitudinal direction. The upper tank 220 has a main part 221 as the semi-container member, and a face of the main part 221 opposing to the core plate 214 is open. The main part 221 integrally has a pipe 221*a*, plural shroud holders 221*b* (4 positions), and plural vehicle mount parts 221*c* (2 positions). Cooling water flows into the tank 220 through the pipe 221*a*. A blower shroud (not shown) is attached to the shroud holders 221*b*. The radiator 200 is attached to a vehicle chassis (not shown) through the vehicle mount parts 221*c*.

The lower tank 230 gathers cooling water from each tube 211, and is made of resin material such as polyamide (PA). The lower tank 230 has an approximately U-shape cross-section when cut in a direction perpendicular to the longitudinal direction, similar to the upper tank 220. The lower tank 230 has a main part 231 as the semi-container member, and a face of the main part 231 opposing to the core plate 214 is open. The main part 231 integrally has a pipe 231*a*, plural shroud holders 231*b* (2 positions), plural vehicle mount parts 231*c* (2 positions), and a drain port 231*d*. Cooling water flows out of the tank 230 through the pipe 231*a*. The blower shroud is attached to the shroud holders 231*b*. The radiator 200 is attached to the vehicle chassis through the vehicle mount parts 231*c*. The drain port 231*d* is used for discharging cooling water at a maintenance time. An oil cooler 240 is disposed in the lower tank 230, and cools automatic transmission fluid (ATF) for an automatic shift of the vehicle.

For example, the radiator 200 is arranged at a front part in an engine compartment of the vehicle, and is located rear of a grill. The vehicle mount part 221*c*, 231*c* is fixed to a frame of the vehicle. An inlet hose extending from the engine is connected to the pipe part 221*a*. An outlet hose extending from the engine is mounted to the pipe part 231*a*.

Cooling water flows into the upper tank 220 from the engine through the inlet hose and the pipe part 221*a*, and is distributed into the tubes 211. While cooling water flows through each of the tubes 211, cooling water is cooled by exchanging heat with air. At this time, the heat exchange is accelerated by the fin 212. Cooling water is gathered by the lower tank 230, and flows toward the engine through the pipe part 231*a* and the outlet hose.

In the radiator 200 of the present embodiment, at a time of assembling the core part 210, the end portion 213*b* of the side plate 213 is inserted into the clearance between the outer wall face 214*a* and the nail 214*d*. Therefore, the side plate 213 is fixed to the core plate 214 by the nail 214*d*, and the tubes 211 and the fins 213 are interposed between two of the side plates 213.

According to the present embodiment, the nail 214*d* has the bent part 214*e*. Therefore, the clearance between the outer wall face 214*a* and the nail 214*d* can be made larger when the side plate 213 is inserted into the clearance.

In a comparison example, a dimension of a core part in a tube layering direction may become larger than a predetermined value because a tube or a fin has a brazing material in advance. In this case, a position of a side plate is easily deviated outward in the tube layering direction. In contrast, according to the present embodiment, because the clearance is made larger by the bent part 214*e*, the position deviation of the side plate 213 can be absorbed. Therefore, the end portion 213*b* of the side plate 213 can be easily inserted into the clearance between the outer wall face 214*a* and the nail 214*d*.

The tip end 213*c* of the side plate 213 has the taper part 213*d*. Therefore, interference between the tip end 213*c* and the bent part 214*e* can be reduced by the taper part 213*d*. Therefore, the end portion 213*b* of the side plate 213 can be more easily inserted into the clearance.

The end position of the nail 214*d* is coincident with the position of the end 211*a* of the tube 211 and the end position of the extension 213*e* in the tube longitudinal direction. Therefore, while the tubes 211 and the side plate 213 are assembled to the core plate 214, the position of the end 211*a* of the tube 211 and the end position of the extension 213*e* can be easily set relative to the end position of the nail 214*d*, by arranging a simple flat board on a side of the core plate 214 adjacent to the upper tank 220. Further, the nail 214*d* can be prevented from being deformed by the end portion 213*b* of the side plate 213.

The bent part 214*e* is not limited to have the linear shape. Alternatively, the bent part 214*e* may have a curved shape.

The taper part 213*d* may be eliminated while the side plate 213 can be easily inserted into the clearance by the bent part 214*e*.

The position of the end 211*a* of the tube 211 and the end position of the extension 213*e* may not be coincident with the end position of the nail 214*d* if an original positioning member is used for the tube 211 and the side plate 213.

The radiator 200 to cool the engine is an example of the heat exchanger. However, the heat exchanger is not limited to the radiator 200. Alternatively, the heat exchanger may be an inter cooler to cool intake air of the engine or a condenser for a refrigerating cycle.

Moreover, the first embodiment and the second embodiment may be combined with each other.

Such changes and modifications are to be understood as being within the scope of the present invention as defined by the appended claims.

What is claimed is:

1. A heat exchanger comprising:

a plurality of tubes layered in a layering direction;

a reinforcing side plate arranged outside of the tubes in the layering direction, the side plate extending in a longitudinal direction of the plurality of tubes;

a core plate extending in a layering direction, a longitudinal end of each of the plurality of tubes being connected to the core plate; and a tank connected to the core plate, wherein the side plate has an end portion in a longitudinal direction of the side plate, and the core plate has a wall portion extending in the longitudinal direction of the plurality of tubes, the wall portion being located on an end portion of the core plate in the layering direction, the end portion of the side plate has a brazing section brazed to an outer face of the wall portion of the core plate, the end portion of the side plate has a through hole located in the brazing section; and the through hole is located at a position at which the side plate overlaps with the outer face of the wall portion of the core plate that is defined by bending an outer periphery of the core plate to extend in the longitudinal direction.

2. The heat exchanger according to claim 1, wherein the through hole has a burr generated by a pressing process, and the burr is located on a face of the side plate opposing to the outer face of the core plate.

3. The heat exchanger according to claim 1, wherein the through hole has an oval shape, and the oval shape has a major axis extending in the longitudinal direction of the side plate.

4. The heat exchanger according to claim 1, wherein the core plate has a U-shaped nail defined by bending a tip end of the wall portion opposing to the tank toward the tube, and the end portion of the side plate is interposed between the outer face and the nail.

5. The heat exchanger according to claim 4, wherein the nail is located outside of the wall portion in the layering direction, and the nail has a bent part defined by bending a tip end of the nail outward in the layering direction.

6. The heat exchanger according to claim 5, wherein the end portion of the side plate has a tip end opposing to the tank, and the tip end has a taper part opposing to the nail.

7. The heat exchanger according to claim 5, wherein the end portion of the side plate has a dimension larger than that of the nail in a width direction perpendicular to the tube layering direction and the tube longitudinal direction, the end portion of the side plate has an extension extending from the tip end toward the tank, and the extension is located outside of the nail in the width direction, and the nail has an end position adjacent to the tank, and the end position of the nail is coincident with a position of the end of the tube and an end position of the extension in the tube longitudinal direction.

8. The heat exchanger according to claim 1, wherein the through hole opens directly to the outer face of the wall portion of the core plate.

* * * * *